US007159498B2

(12) United States Patent
Stewart

(10) Patent No.: US 7,159,498 B2
(45) Date of Patent: Jan. 9, 2007

(54) MITER BOX FOR GUIDING A CIRCULAR SAW

(76) Inventor: Denham Ray Stewart, 4222 Inverrary Blvd., #4206, Lauderhill, FL (US) 33319

( * ) Notice: Subject to any disclaimer, the term of this patent is extended or adjusted under 35 U.S.C. 154(b) by 0 days.

(21) Appl. No.: 11/332,889

(22) Filed: Jan. 17, 2006

(65) Prior Publication Data

US 2006/0112806 A1 Jun. 1, 2006

Related U.S. Application Data

(63) Continuation-in-part of application No. 10/397,091, filed on Jun. 16, 2003, now abandoned.

(51) Int. Cl.
*B27B 9/04* (2006.01)
*B26B 29/00* (2006.01)

(52) U.S. Cl. ..... 83/745; 83/581; 83/762; 83/821

(58) Field of Classification Search ..... 83/454, 83/745, 762, 581, 821; 30/286, 289, 371; D10/65

See application file for complete search history.

(56) References Cited

U.S. PATENT DOCUMENTS 2,949,139 A * 8/1960 Nolte ..... 83/522.25
3,124,175 A * 3/1964 McCloud ..... 33/443
3,171,453 A * 3/1965 Brownrigg ..... 83/762
3,397,722 A * 8/1968 Long ..... 83/762
3,731,572 A 5/1973 Crooks
3,830,130 A * 8/1974 Moore ..... 83/745
4,051,759 A * 10/1977 Oliff ..... 83/471.3
4,054,077 A 10/1977 Gram
4,608,898 A * 9/1986 Volk ..... 83/745
4,907,482 A * 3/1990 Hujo ..... 83/745
5,182,975 A * 2/1993 Warner ..... 83/745
5,226,345 A 7/1993 Gamble
5,787,782 A * 8/1998 Downard et al. ..... 83/574
5,983,767 A * 11/1999 DeFelice et al. ..... 83/745

* cited by examiner

*Primary Examiner*—Hwai-Siu Payer
(74) *Attorney, Agent, or Firm*—Sacco & Associates, PA; Robert J. Sacco

(57) ABSTRACT

The invention relates to an improved miter box for guiding a handheld portable circular saw. The miter box facilitates several conventional workpiece trim cuts using a handheld portable circular saw, including 45 degree and 90 degree straightcuts, as well as 45 and 90 degree straightcuts with a 45 degree undercut. The invention includes an I-beam that is formed from a rigid base plate having opposing first and second base plate edges disposed along its elongated length. A first and second flange can be respectively attached to the opposing first and second base plate edges. Each of the flanges can include a pair of opposing support faces. One or more transverse guide members can extend either 45, 135, or 90 degrees from one support face of the first flange to another support face of the second flange. The transverse guide member(s) and the support faces provide a friction reduced medium by which the bottom of a handheld portable circular saw's shoe can glide with greater ease and stability.

19 Claims, 5 Drawing Sheets

206
119
204
207
107
ε
122
121
203
205
120
100
130
112
202
116
115
117
111
105
108
107
∝
102
118
201
101
103
104

105
103
δ
101
119
104
102
130
114
113
∝
100
205
127
128
129
110
204
207
118
202
206
109

MITER BOX FOR GUIDING A CIRCULAR SAW

CROSS REFERENCE TO RELATED APPLICATIONS

This application is a Continuation-in-part of U.S. application Ser. No. 10/397,091 filed on Jun. 16, 2003 now abandoned.

BACKGROUND OF THE INVENTION

1. Statement of the Technical Field

The inventive arrangements relate to miter boxes for trim carpentry work. In particular, the invention relates to an improved miter box for guiding a handheld circular saw.

2. Description of the Related Art

In the field of trim carpentry work, it is desirable to use a saw guide or miter box to ensure a straight, smooth and accurate cut. Such cuts include 45 degree straightcuts to unite the corners of a door frame molding. Another example includes 90 degree straightcuts with a 45 degree undercut to unite baseboards at a corner of a room. Absent a saw guide or miter box, a user must typically mark a straight line in pencil with the help of a straightedge and protractor and attempt to manually guide the saw along the marked line. Moreover, making accurate and smooth straightcuts and undercuts in a workpiece using a handheld portable circular saw has been a long standing problem in the field. Handheld power saws, by their very nature, have no precise cutting path. Compounding the problem, the operational vibration caused by a handheld power saw makes it even more difficult to maintain a steady cutting path. Also, it is sometimes difficult to make certain cuts using circular saws that are designed for right handed individuals Miter saws have been the common type of equipment used in the field of trim carpentry. However, there are several disadvantages in using a miter saw. First of all, miter saws are very expensive and are prone to be stolen or damaged at a construction site. Second, they are difficult to transport given their bulky size and relatively heavy weight. Moreover, given that the great majority of cuts used in trim carpentry work involve simple 45 and 90 degree angles, a miter saw's wide range of adjustable angle cuts would appear to be unnecessary for most types of trim work.

In the past, several kinds of portable miter boxes have tried to address some, but not all of the problems discussed earlier. Another unresolved problem using miter boxes is that they are usually adapted for right-handed saw operation only. Therefore, what is needed is a miter box that can be used universally with circular saws that are adapted for either right or left handed individuals. Additionally, the improved miter box should be designed so that it can assist in creating a 45 degree undercut along a 90 degree angled cut. In addition, the miter box should be designed such that the shoe of the handheld portable circular saw is afforded more stability and easier alignment with the saw guide of a miter box.

SUMMARY OF THE INVENTION

The present invention relates to a miter box for guiding a circular saw. The miter box can include an I-beam formed from a rigid base plate. The rigid base plate can have opposing first and second base plate edges disposed along the elongated length of the rigid base plate. A first flange and a second flange can be respectively attached to the opposing first and second base plate edges along the elongated length of the rigid base plate. The first and second flanges can be disposed generally transverse to the rigid base plate so as to define one or more channels between the first and second flanges.

The first and second flanges can each have a pair of opposing support faces. The opposing support faces on each of the first and second flanges can be disposed along opposing edge portions of each of the first and second flanges distal from the rigid base plate. A distance between the first and second flange can be chosen so that it is less than a length of a shoe of a circular saw with which the miter box is designed to be used. Consequently, the table can always be supported on at least two transverse surfaces when performing a cut.

A first transverse guide member can extend from a first support face on the first flange to a second support face on the second flange. The first transverse guide member can include a first guide surface and a second guide surface. The first guide surface can extend transversely to the first and the second support faces disposed on the first and second flanges, respectively. The second guide surface can be aligned with at least a portion of the first and second support faces. The first guide surface can be positioned a predetermined distance from an end portion of the I-beam. For example, the predetermined distance can be less than a distance between a saw blade and a shoe edge of a circular saw. The first guide surface, the second guide surface, a portion of the first support face and/or a portion of the second support face can be formed of a friction reducing material.

The miter box can further include opposing third and fourth base plate edges. The opposing third and fourth base plate edges can respectively extend between opposing ends of the first and second base plate edges. Notably, the opposing first and second base plate edges can be of unequal length. Consequently, one or more of the third and fourth base plate edge portions can form an angle of either about 45 degrees or 135 degrees with one or more of the first and second base plate edges. Moreover, the first guide surface can form an angle of about 45 degrees or 135 degrees with one or more of the first and second base plate edges.

In addition to a first transverse guide member, the miter box can include a second transverse guide member. The second transverse guide member can also extend from the first support face on the first flange to the second support face on the second flange. The second transverse guide member can include a third guide surface and a fourth guide surface. The third guide surface can extend transversely to the first and the second support faces disposed on the first and second flanges, respectively. The fourth guide surface can be aligned with at least a portion of the first and second support faces. The third guide surface can be positioned a predetermined distance from an end portion of the I-beam. The predetermined distance can be less than a distance between a saw blade and a shoe edge of a circular saw. The third guide surface, fourth guide surface, a portion of the first support face, and a portion of the second support face can be formed of a friction reducing material.

The first and second flanges can each have a first and second flange end face. The first and second flange end faces can extend between the pair of opposing support faces on the first flange (first and third support faces) and on the second flange (second and fourth support faces). One or more of the first and second flange ends can each form a 45 degree angle with one or more of the pair of opposing support faces.

Alternatively, both of the first and second flange end faces can form a 45 degree angle with one or more of the pair of opposing support faces.

In addition to the first and second transverse guide members, the miter box can include a third transverse guide member. The third transverse guide member can extend from the third support face on the first flange to the fourth support face on the second flange. The third transverse guide member can include a fifth guide surface and a sixth guide surface. The fifth guide surface can extend transversely to the third and the fourth support faces disposed on the first and second flanges, respectively. The sixth guide surface can be aligned with at least a portion of the third and fourth support faces. The fifth guide surface can be positioned a predetermined distance from an end portion of the I-beam. For example, the predetermined distance can be less than a distance between a saw blade and a shoe edge of a circular saw. The fifth and/or sixth guide surfaces and/or a portion of the third and/or fourth support faces can be formed of a friction reducing material. Furthermore, the third transverse guide member can be aligned with the first transverse guide member.

Another embodiment of the invention can include two or more spacer elements that can be attached to the support faces in order to provide greater stability to the miter box.

DETAILED DESCRIPTION OF THE PREFERRED EMBODIMENTS

Figure 1:
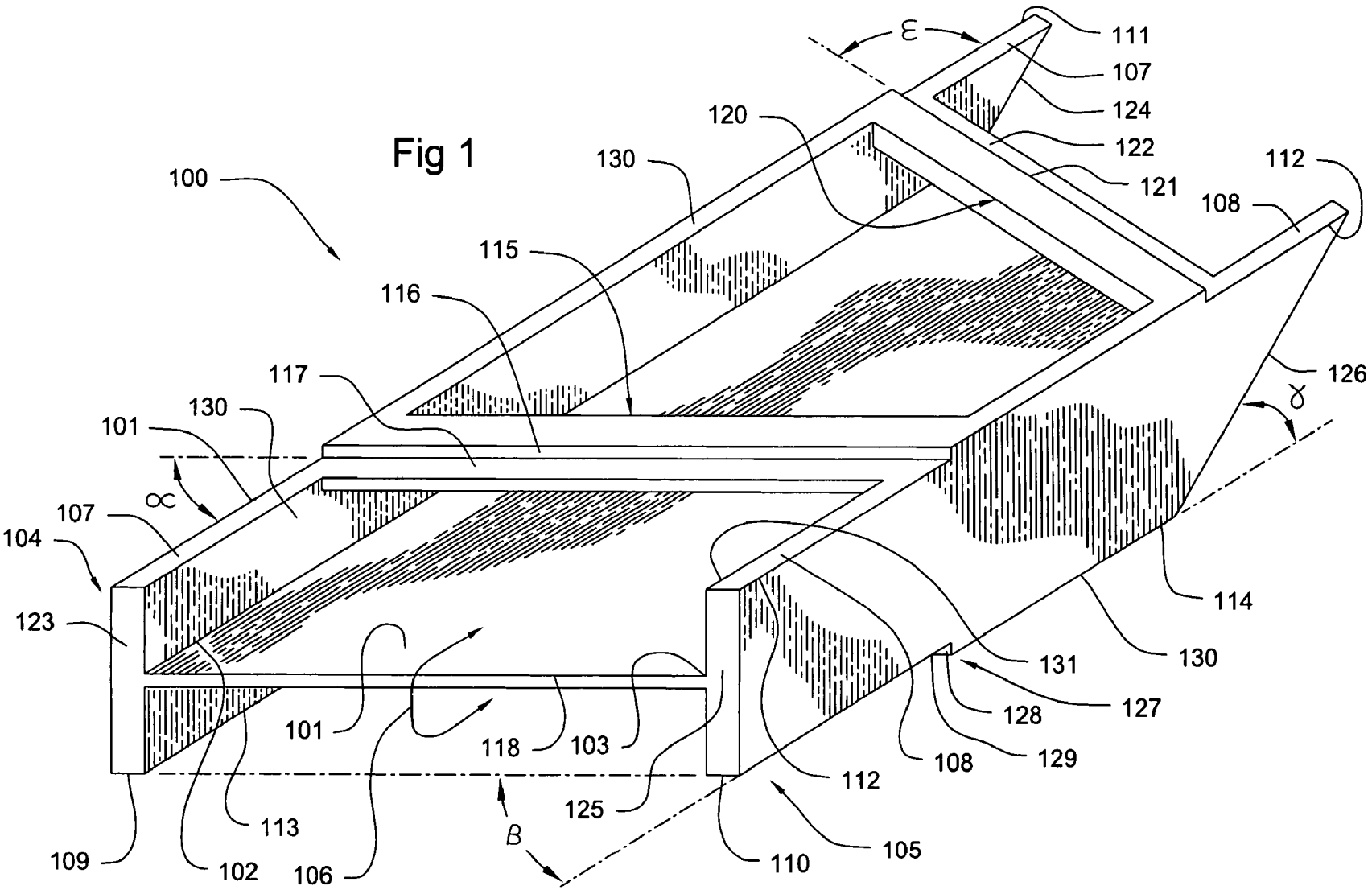
FIG. 1 is a perspective view of the miter box that is useful for understanding the invention.

Referring particularly to FIG. 1, there is shown an improved miter box 100. The miter box 100 can include an I-beam comprised of a rigid base plate 101. The rigid base plate 101 can include opposing first and second base plate edges, 102 and 103 respectively. The first and second base plate edges 102, 103 can be disposed along an elongated length of the rigid base plate 101. The rigid base plate 101 and the miter box 100, in general, can be formed of molded plastic, wood, or metal. However, the invention is not limited in this regard and other materials may be used so long as the miter box 100 can provide a strong and durable surface to support the weight of a workpiece 206 to be cut, a circular saw's weight and vibration, and the pressure applied by the user to the miter box when operating the saw.

A first flange 104 and a second flange 105 can be respectively attached to the opposing first and second base plate edges 102, 103 along the elongated length of the rigid base plate 101. The first and second flanges 104, 105 can be disposed generally transverse to the rigid base plate 101 so as to define one or more channels 106 between the first and second flanges 104, 105. For example, the flanges can form an angle of about 90 degrees with the base plate. The channels 106 can be formed to support the weight of a workpiece to be cut. The workpiece can be disposed through these channels and rest atop of the rigid base plate 101. Moreover, the work piece can be held in place such that it is supported and aligned by the rigid base plate 101 and portions of interior faces of the first and second flanges 130, 131.

The first and second flanges 104, 105 can each have a pair of opposing support faces 107–110. The opposing support faces on the first flange 104 can include a first and a third support face, 107 and 109 respectively. The opposing support faces on the second flange can include a second and a fourth support face, 108 and 110 respectively. The opposing support faces 107–110 on each of the first and second flanges 104, 105 can be disposed along opposing edge portions 111–114 of each of the first and second flanges 104, 105 distal from the rigid base plate 101. The combination of the first and second support faces 107, 108 can support a circular saw, where portions of a saw's shoe (referred to as 207 and shown using phantom lines in FIGS. 2, 3, and 5) rests on the support faces. Alternatively, if the miter box is turned upside-down, the combination of the third and fourth support faces 109, 110 can also be used to support a circular saw, where portions of the saw's shoe 207 rests on the support faces 109, 110.

A first transverse guide member 115 can extend from the first support face 107 on the first flange 104 to the second support face 108 on the second flange 105. The first transverse guide member 115 can include a first guide surface 116 and a second guide surface 117. The first guide surface 116 can extend transversely to the first and the second support faces 107, 108 disposed on the first and second flanges 104, 105, respectively. The second guide surface 117 can be aligned with at least a portion of the first and second support faces 107, 108. A saw's shoe 207 can rest on the smooth surface formed from the combination of the first and second support faces 107, 108 and the second guide surface 117. The side edge 205 of the shoe 207 can be aligned and guided by the first guide surface 116. In order to facilitate the operation of the circular saw, the first and second support faces 107, 108 and the first and second guide surfaces 116, 117 can be formed or coated with a friction reducing material. Examples of friction reducing coatings include, but are not limited to polytetrafluoroethylene (PTFE), fluorinated ethylenepropylene (FEP), polyvinylidene fluoride (PVDF), perfluoroalkoxy (PFA), ethylene chlorotrifluoroethylene (ECTFE), molybdenum disulfide ($MoS_2$), and other polymer blends. The friction reducing material would allow the saw's shoe 207 to glide easier over the surfaces 107, 108, 116, 117 while the saw is in operation.

Figures 2, 3:
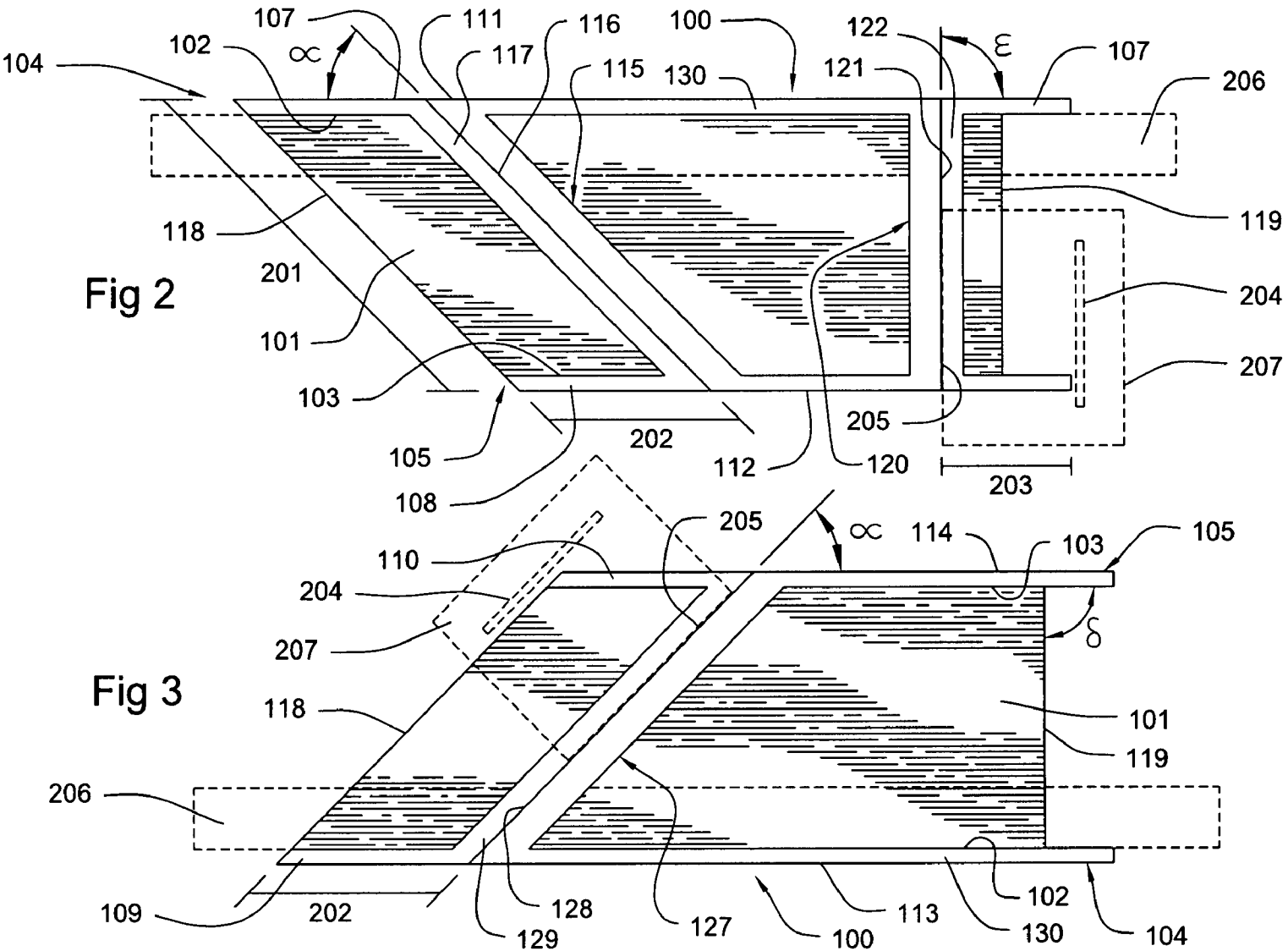
FIG. 2 is a top view of the miter box that is useful for understanding the invention.
FIG. 3 is a bottom view of the miter box that is useful for understanding the invention.
Figure 5:
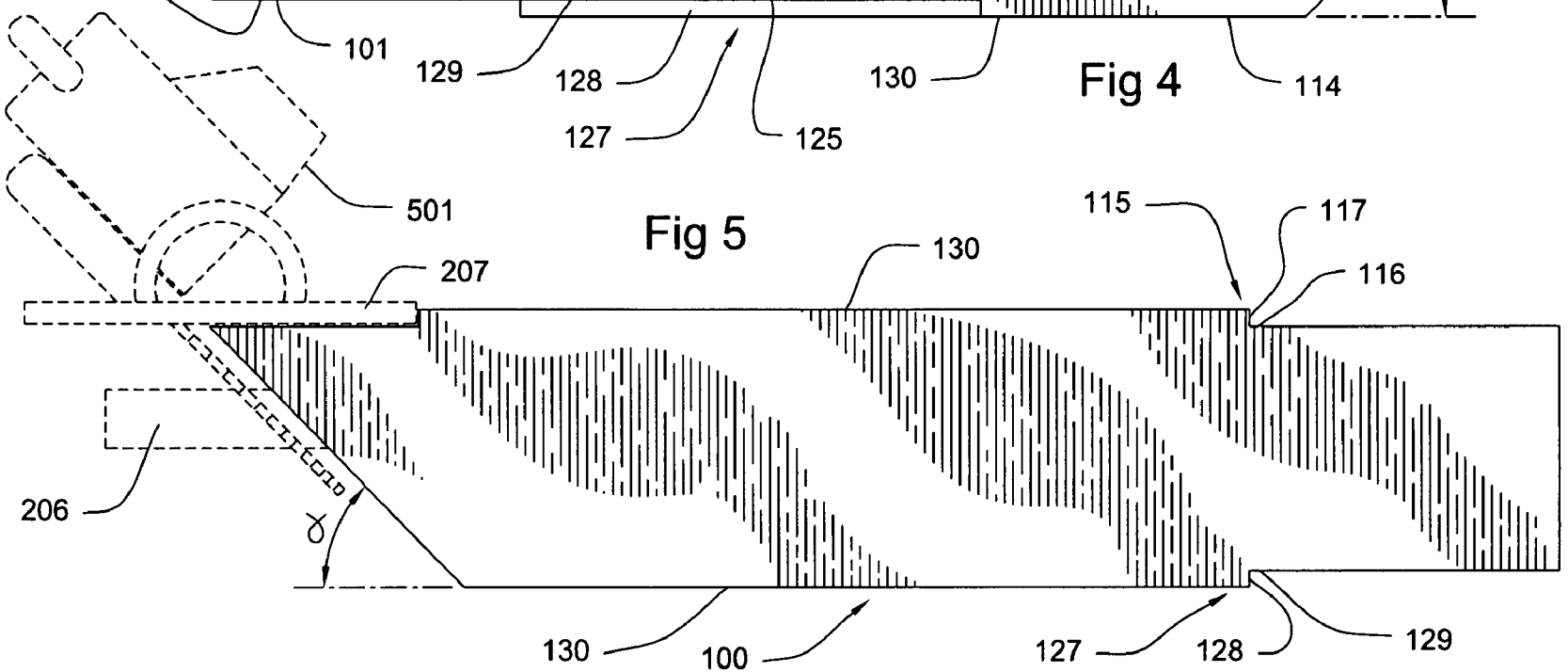
FIG. 5 is a rear elevational view of the miter box that is useful for understanding the invention.

Referring now to FIGS. 2 and 5, the first guide surface 116 can be positioned a predetermined distance 202 from an end portion of the I-beam. The predetermined distance 202 can be less than a distance between a saw blade 204 (shown using phantom lines) and a shoe edge 205 of a circular saw 501 (both shown using phantom lines). The predetermined distance can be designed such that the end portions of the I-beam do not interfere with the cutting motion of the saw blade 204 when cutting a workpiece 206 (shown using phantom lines).

Referring back to FIGS. 1 and 2, the miter box 100 can further include opposing third and fourth base plate edges, 118 and 119 respectively. The opposing third and fourth base plate edges 118, 119 can respectively extend between opposing ends of the first and second base plate edges 102, 103. The opposing first and second base plate edges 102, 103 can be of unequal length to provide an angled end(s) to the miter box. For example, FIG. 1 shows how the third base plate edge portion 118 can form an angle β of 45 degrees with one or more of the first and second base plate edges 102, 103. Similarly shown in FIGS. 1 and 2, the first guide surface 116 can form an angle α of about 45 degrees with one or more of the first and second base plate edges 102, 103. Moreover, referring to FIG. 3, the fourth base plate edge portion 119 can form an angle δ of 90 degrees with one or more of the first and second base plate edges 102, 103. Finally, the third guide surface 122 can form an angle E of about 90 degrees with one or more opposing edge portions 111, 112.

In addition to a first transverse guide member 115, the miter box 100 can include a second transverse guide member 120, shown in FIGS. 1 and 2. The second transverse guide member 120 can extend from the first support face 107 on the first flange 104 to the second support face 108 on the second flange 105. The second transverse guide member 120 can include a third guide surface 121 and a fourth guide surface 122. The third guide surface 121 can extend transversely to the first and the second support faces 107, 108 disposed on the first and second flanges 104, 105, respectively. The fourth guide surface 122 can be aligned with at least a portion of the first and second support faces 107, 108. One or more cap frame(s) 130 can be disposed on portions of the support faces 107–110. The cap frame(s) 130 can include a portion of one or more of the transverse guide members 115, 120, and 127.

A saw's shoe 207 can rest on the smooth surface formed from the combination of the first and second support faces 107, 108 and the fourth guide surface 122. The side edge 205 of the shoe 207 can be aligned and guided by the third guide surface 121. In order to facilitate the operation of the circular saw, the first and second support faces 107, 108 and the third and fourth guide surfaces 121, 122 can be formed or coated with a friction reducing material such as the ones discussed earlier. The friction reducing material would allow the saw's shoe 207 to glide more easily over the surfaces 107, 108, 121, 122 while the saw is in operation.

The third guide surface 121 can be positioned a predetermined distance 203 from an end portion of the I-beam. The predetermined distance 203 can be less than a distance between a saw blade and a shoe edge of a circular saw 205. As mentioned earlier, the predetermined distance can be designed such that the end portions of the I-beam do not interfere with the cutting motion of the saw blade.

Figure 6:
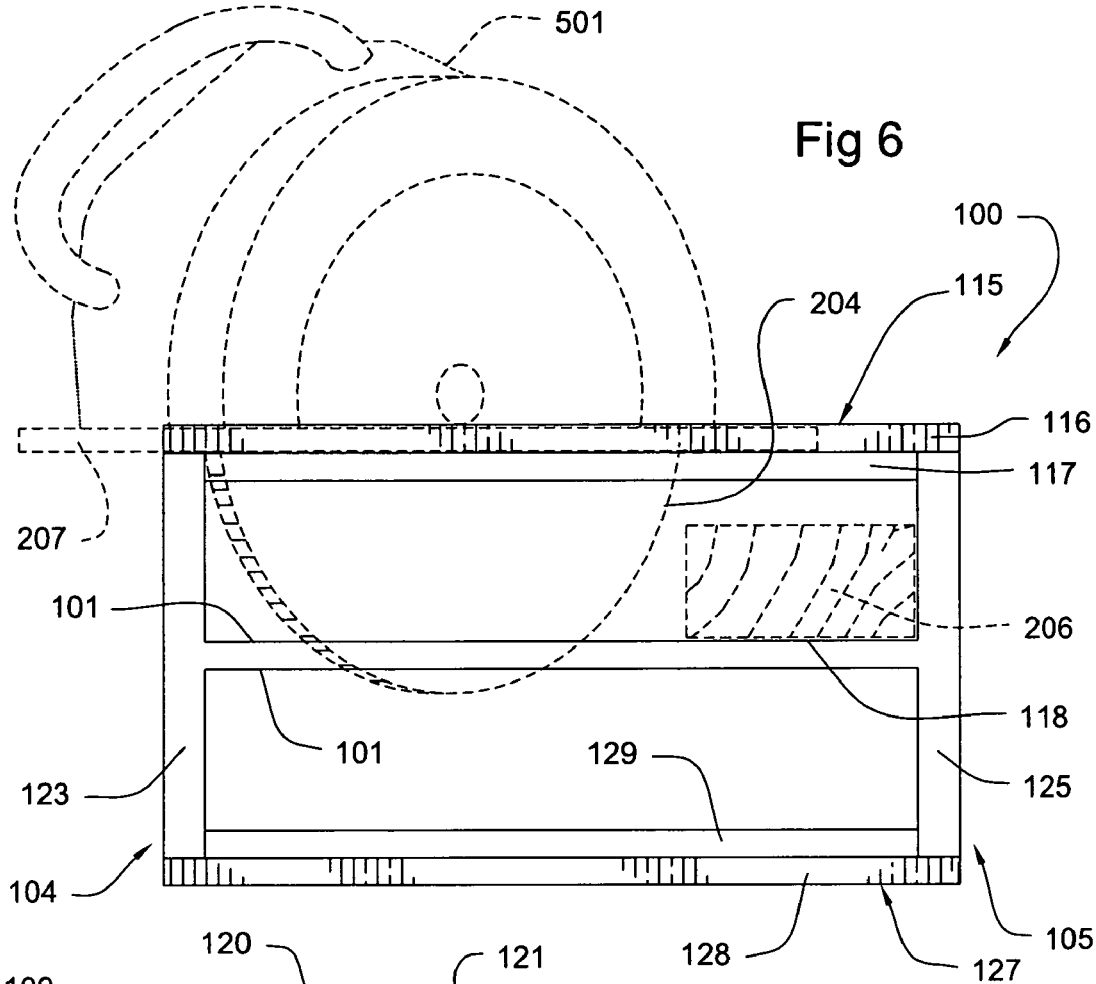
FIG. 6 is a right side elevational view of the miter box that is useful for understanding the invention.
Figure 7:
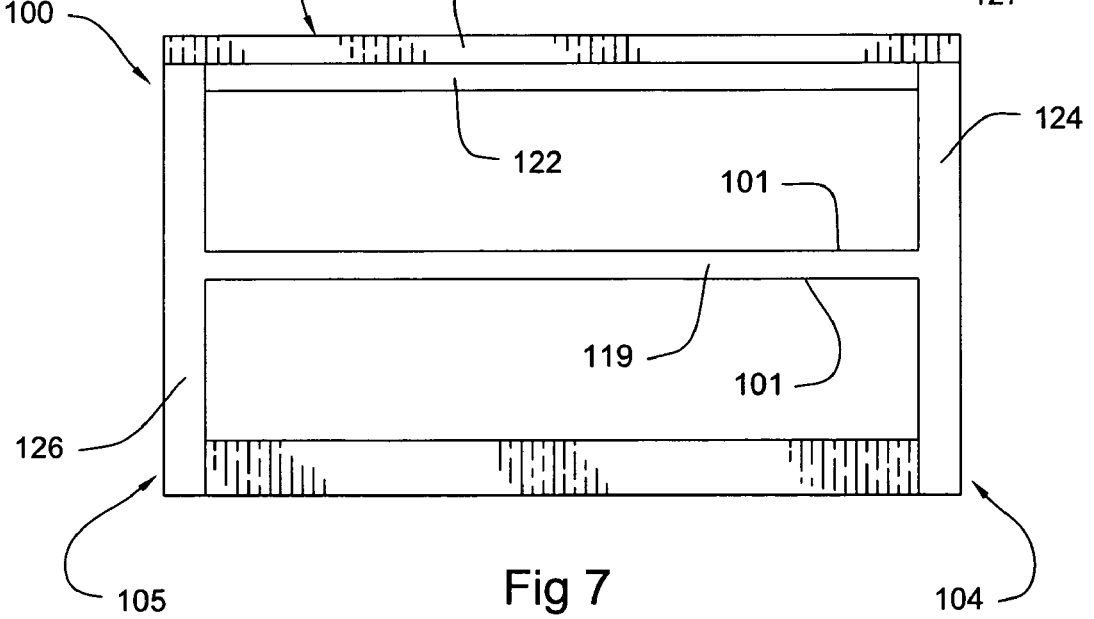
FIG. 7 is a left side elevational view of the miter box that is useful for understanding the invention.

The first and second flanges 104, 105 can each have a first and second flange end faces 123–126. FIGS. 1, 6, and 7 illustrate the placement of these end faces 123–126. The first and second flange end faces of the first flange 123, 124 can extend between the pair of opposing support faces on the first flange (first and third support faces 107, 109). The first and second flange end faces of the second flange 125, 126 can extend between the pair of opposing support faces on the second flange (second and fourth support faces 108, 110).

Figure 4:
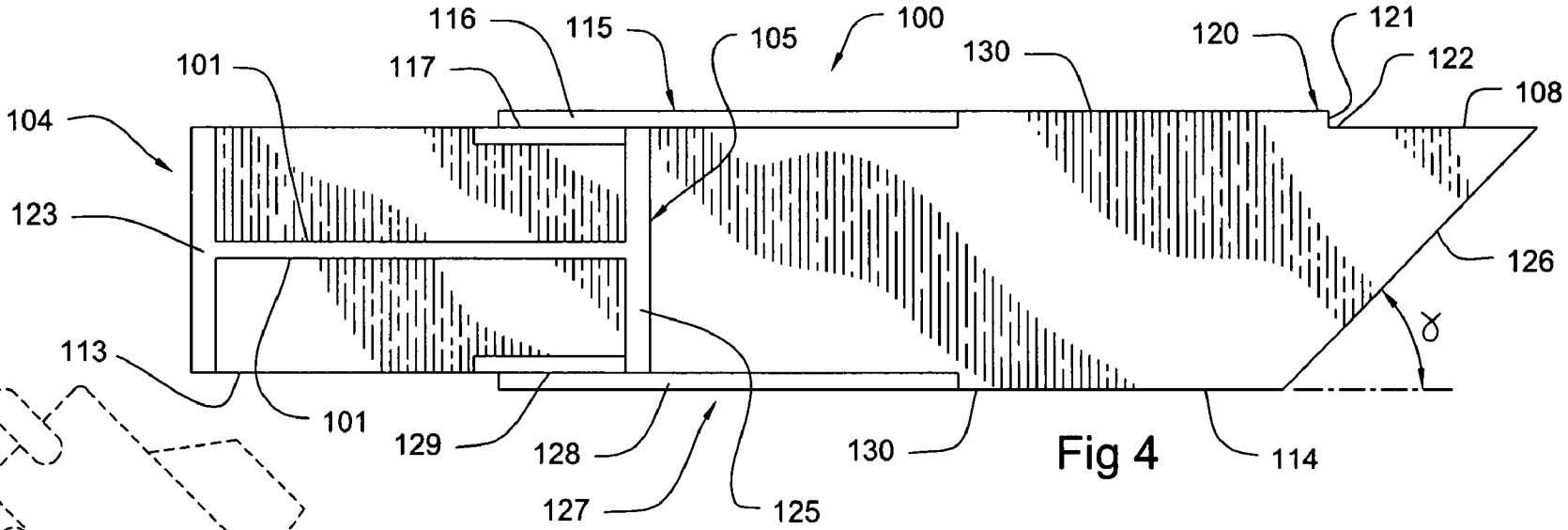
FIG. 4 is a front elevational view of the miter box that is useful for understanding the invention.

Referring now to FIGS. 1, 4, and 5, one or more of the first and second flange end faces 124, 126 can each form a 45 degree angle γ with one or more of the respective support faces 107, 108. According to another embodiment of the invention, both of the first and second flange end faces 123–126 can form the 45 degree angle γ with one or more of the pair of opposing support faces 107–110. Given that conventional circular saws have a mechanism whereby the saw blade can be tilted 45 degrees relative to a level shoe 207, the 45 degree angle γ can be formed so that a circular saw (501, shown using phantom outline) may be adjusted to perform 45 degree undercuts, as shown in FIG. 5.

In addition to the first and second transverse guide members 115, 120, the miter box 100 can include a third transverse guide member 127, shown in FIGS. 1 and 3. The third transverse guide member 127 can extend from the third support face 109 on the first flange 104 to the fourth support face 110 on the second flange 105. The third transverse guide member 127 can include a fifth guide surface 128 and a sixth guide surface 129.

The fifth guide surface 128 can extend transversely to the third and the fourth support faces 109, 110 disposed on the first and second flanges 104, 105, respectively. The sixth guide surface 129 can be aligned with at least a portion of the third and fourth support faces 109, 110. The saw's shoe 207 can rest on the smooth surface formed from the combination of the third and fourth support faces 109, 110 and the sixth guide surface 129. The shoe edge 205 of the saw's shoe 207 can be aligned and guided by the fifth guide surface 129. In order to facilitate the operation of the circular saw, the third and fourth support faces 109, 110 and the fifth and sixth guide surfaces 128, 129 can be formed or coated with a friction reducing material such as the ones discussed earlier. The friction reducing material would allow the shoe 207 to glide more easily over the surfaces 109, 110, 128, 129 while the saw is in operation.

The fifth guide surface 128 can be positioned a predetermined distance 202 from an end portion of the I-beam. The predetermined distance 202 can be less than a distance between a saw blade and a shoe edge 205 of a circular saw. As mentioned earlier, the predetermined distance can be designed such that the end portions of the I-beam do not interfere with the cutting motion of the saw blade. Furthermore, the third transverse guide member 127 can be aligned with the first transverse guide member 115. This alignment of the first and third transverse guide members 115 and 127 can expand the functionality of the miter box by adapting the miter box for right or left handed saw users.

Figure 8:
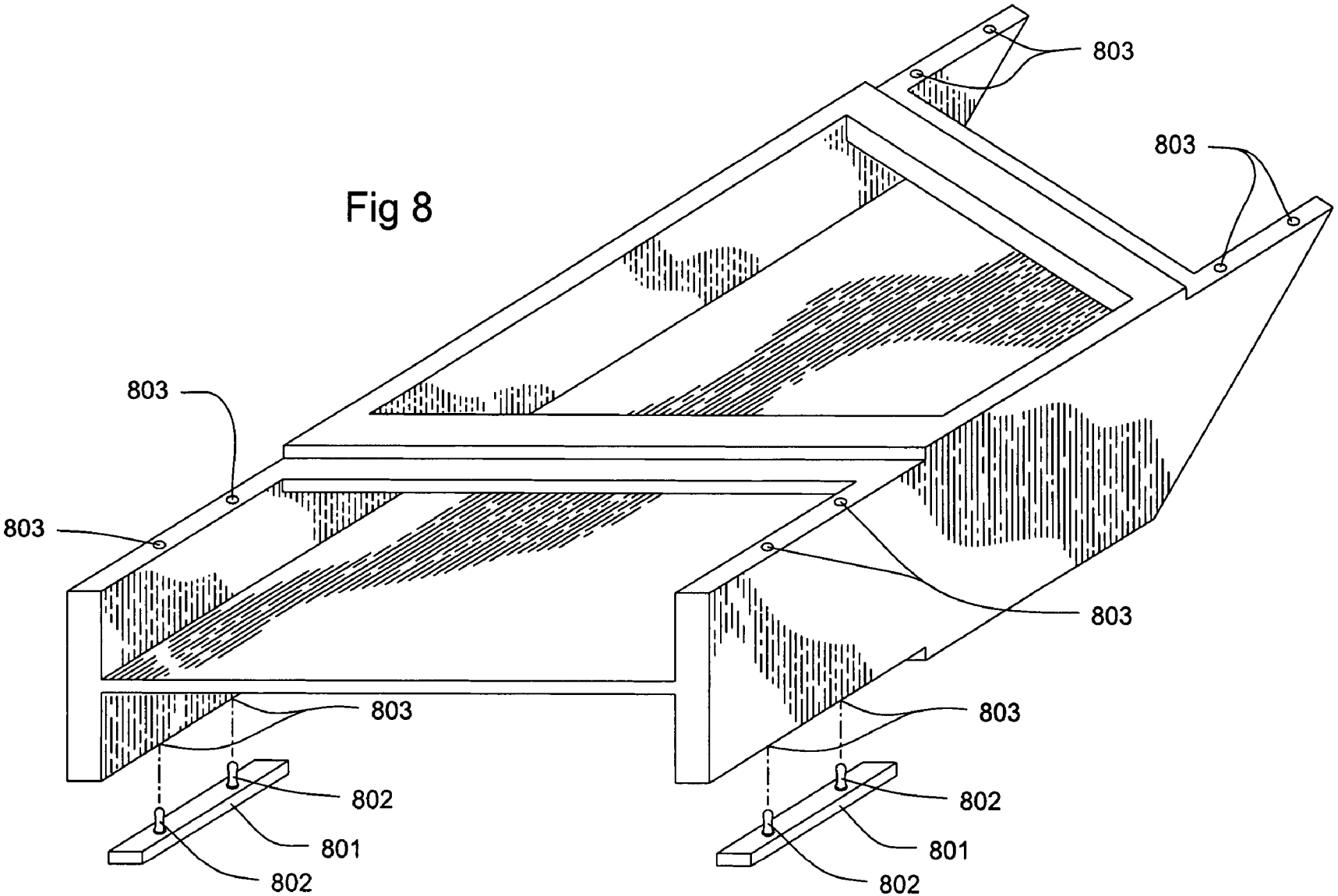
FIG. 8 is perspective view of another embodiment of the miter box that is useful for understanding the invention.

According to another embodiment of the invention shown in FIG. 8, one or more spacer elements 801 can be removably coupled to one or more support faces 107–110 in order to provide additional stability to the miter box 100. When operating the saw with the miter box, the spacer element(s) 801 can be coupled to those support faces that are not in use. The spacer element 801 can include one or more tabs 802 that can frictionally engage with one or more notches 803 formed on the support faces 107–110. In one alternative, the spacer element 801 and tabs 802 can be formed of a resilient and shock absorbent material to dampen the operational vibration of the circular saw 501. Such resilent and shock absorbent material can include, but is not limited to, rubber/elastomer types such as polyurethane rubber, buna rubber, Viton® rubber, neoprene™, EPDM rubber, silicone RTV, fluorosilicone rubber, and other polymer materials.

While specific embodiments of the invention have been disclosed, it will be appreciated by those skilled in the art that various modifications and alterations to those details could be developed in light of the overall teachings of the disclosure. Accordingly, the particular arrangements disclosed are meant to be illustrative only and not limiting as to the scope of the invention which is to be given the full breadth of the appended claims and any and all equivalents thereof.

What is claimed is:

1. A miter box for guiding a circular saw, comprising:

an I-beam comprised of a rigid base plate having opposing first and second base plate edges disposed along its elongated length, and a first flange and a second flange respectively attached to said opposing first and second base plate edges along said elongated length of said rigid base plate, said first and second flanges disposed generally transverse to said rigid base plate so as to define at least one channel between said first and second flanges;

said first and second flanges each having a pair of opposing support faces disposed along opposing edge portions of each said first and second flanges distal from said rigid base plate;

a first transverse guide member extending from a first one of said support faces on said first flange to a second one of said support faces on said second flange, said first transverse guide member having a first guide surface extending transverse to said support faces and a second guide surface aligned with at least a portion of said first and second support faces, said first guide surface positioned a predetermined distance from an end portion of said I-beam.

2. The miter box according to claim 1, wherein said rigid base plate is further comprised of opposing third and fourth base plate edges respectively extending between opposing ends of said first and second base plate edges.

3. The miter box according to claim 2, wherein said opposing first and second base plate edges are of unequal length.

4. The miter box according to claim 3, wherein at least one of said third and fourth base plate edges forms an angle of about 45 degrees or 135 degrees with at least one of said first and second base plate edges.

5. The miter box according to claim 4, wherein said first guide surface forms an angle of about 45 degrees or 135 degrees with at least one of said first and second base plate edges.

6. The miter box according to claim 1, wherein said predetermined distance is less than a distance between a saw blade and a shoe edge of a circular saw.

7. The miter box according to claim 1, wherein the first and second guide surfaces and a portion of the first and second support faces are formed of a friction reducing material.

8. The miter box according to claim 1, further comprising a second transverse guide member extending from said first one of said support faces on said first flange to said second one of said support faces on said second flange, said second transverse guide member having a third guide surface extending transverse to said support faces and a fourth guide surface aligned with at least a portion of said first and second support faces, said third guide surface positioned a predetermined distance from an end portion of said I-beam.

9. The miter box according to claim 8, wherein said first and second flanges each have first and second flange end faces extending between said pair of opposing support faces forming each flange.

10. The miter box according to claim 9, wherein at least one of said first and second flanges end faces form a 45 degree angle with at least one of said pair of opposing support faces.

11. The miter box according to claim 9, wherein both of said first and second flange end faces form a 45 degree angle with at least one of said pair of opposing support faces formed on each said first and second flanges.

12. The miter box according to claim 8, wherein said predetermined distance is less than a distance between a saw blade and a shoe edge of a circular saw.

13. The miter box according to claim 8, wherein the third and fourth guide surfaces and a portion of the first and second support faces are formed of a friction reducing material.

14. The miter box according to claim 1, further comprising a third transverse guide member extending from a third one of said support faces on said first flange to a fourth one of said support faces on said second flange, said third guide transverse member having a fifth guide surface extending transverse to said support faces and a sixth guide surface aligned with at least a portion of said third and fourth support faces, said fifth guide surface positioned a predetermined distance from an end portion of said I-beam.

15. The miter box according to claim 14, wherein said third transverse guide member is aligned with said first transverse guide member.

16. The miter box according to claim 14, wherein said predetermined distance is less than a distance between a saw blade and a shoe edge of a circular saw.

17. The miter box according to claim 14, wherein the fifth and sixth guide surfaces and a portion of the third and fourth support faces are formed of a friction reducing material.

18. The miter box according to claim 14, wherein a distance between said first flange and said second flange is less than a length of a shoe of a circular saw for which said miter box is designed to be used, whereby said shoe is always supported on at least two transverse surfaces when performing a cut.

19. A miter box for guiding a circular saw, comprising:

an I-beam comprised of a rigid base plate having opposing first and second base plate edges disposed along its elongated length and a first flange and a second flange respectively attached to said opposing first and second base plate edges along said elongated length of said rigid base plate, said first and second flanges disposed generally transverse to said rigid base plate so as to define at least one channel between said first and second flanges;

said first and second flanges each having a pair of opposing support faces disposed along opposing edge portions of each said first and second flanges distal from said rigid base plate;

a first transverse guide member extending from a first one of said support faces on said first flange to a second one of said support faces on said second flange, said first transverse guide member having a first guide surface extending transverse to said support faces and a second guide surface aligned with at least a portion of said first and second support faces, said first guide surface positioned a predetermined distance from an end portion of said I-beam;

wherein said first and second flanges each have a first and second flange end faces extending between said pair of opposing support faces forming each flange, wherein at least one of said first and second flange end faces form a 45 degree angle with at least one of said pair of opposing support faces.

* * * * *